US008631819B2

(12) United States Patent
McKee et al.

(10) Patent No.: US 8,631,819 B2
(45) Date of Patent: Jan. 21, 2014

(54) GAS SUPPLY SYSTEM FOR PNEUMATIC STORE EJECTION UTILIZING A REMOVABLE, REPLACEABLE AND ON-BOARD RECHARGEABLE GAS STORAGE VESSEL

(75) Inventors: Joseph R. McKee, Ventura, CA (US); Kenneth Bram, Huntington, NY (US)

(73) Assignee: Ausco, Inc., Farmingdale, NY (US)

( * ) Notice: Subject to any disclaimer, the term of this patent is extended or adjusted under 35 U.S.C. 154(b) by 989 days.

(21) Appl. No.: 11/951,637

(22) Filed: Dec. 6, 2007

(65) Prior Publication Data

US 2009/0145513 A1 Jun. 11, 2009

(51) Int. Cl.

| | |
|---|---|
| ***F16K 31/12*** | (2006.01) |
| ***F16K 31/36*** | (2006.01) |
| ***F41B 11/00*** | (2013.01) |

(52) U.S. Cl.

USPC ..... 137/490; 137/488; 137/489; 137/489.5; 124/65; 124/73; 251/30.02

(58) Field of Classification Search

USPC ..... 137/488, 489, 489.5, 490, 500, 503, 137/506; 251/28, 29, 30.01, 30.02, 38, 39; 141/3, 20, 197, 302; 124/63, 64, 65, 124/66, 67, 69, 73, 74, 75, 77

See application file for complete search history.

(56) References Cited

U.S. PATENT DOCUMENTS

| | | | | |
|---|---|---|---|---|
| 3,319,791 | A | 5/1967 | Horne | |
| 3,731,905 | A | 5/1973 | Piet | |
| 3,903,914 | A * | 9/1975 | Topham-Clements | 137/68.23 |
| 4,408,722 | A | 10/1983 | Frelund | |
| 4,667,695 | A * | 5/1987 | Gold et al. | 137/486 |
| 4,763,690 | A | 8/1988 | Martin | |
| 4,850,392 | A | 7/1989 | Crump et al. | |
| 5,927,329 | A * | 7/1999 | Yie | 137/624.13 |
| 6,347,768 | B1 * | 2/2002 | Jakubowski et al. | 244/137.4 |
| 6,745,992 | B2 | 6/2004 | Yang et al. | |
| 6,869,060 | B2 | 3/2005 | Barber et al. | |
| 6,892,985 | B2 * | 5/2005 | Jakubowski, Jr. | 244/137.4 |

FOREIGN PATENT DOCUMENTS

| | | |
|---|---|---|
| GB | 112112 | 12/1917 |

OTHER PUBLICATIONS

International Search Report dated Jun. 19, 2009 for patent application No. PCT/US2009/042097.

International Search report dated Feb. 13, 2009 for patent application No. PCT/US2008/085717.

* cited by examiner

*Primary Examiner* — Ryan Reis

(74) *Attorney, Agent, or Firm* — F. Chau & Associates, LLC

(57) ABSTRACT

A gas supply system includes a receiver assembly, a gas storage vessel coupled to the receiver assembly, a main poppet positioned at an end of the gas storage vessel and sealing the gas storage vessel when the main poppet is closed, a pilot poppet positioned in the main poppet and sealing the gas storage vessel when the pilot poppet is closed, and a chamber positioned behind the main poppet, wherein when the pilot poppet opens, gas from the gas storage vessel is released into the chamber to exert pressure on the main poppet to open the main poppet.

23 Claims, 20 Drawing Sheets

GAS SUPPLY SYSTEM FOR PNEUMATIC STORE EJECTION UTILIZING A REMOVABLE, REPLACEABLE AND ON-BOARD RECHARGEABLE GAS STORAGE VESSEL

BACKGROUND OF THE INVENTION

1. Technical Field

The present disclosure relates to a gas supply system for pneumatic store ejection, and more particularly, to a self contained, fast acting, high flow gas supply system for pneumatic store ejection.

2. Discussion of the Related Art

A store is, for example, a bomb, missile, rocket and the like. Pressurized gas has been used to actuate store ejector mechanisms, such as, for example, pistons and suspension and release equipment on bomb racks, to permit forceful ejection of a store while a vehicle is in motion. It is to be understood that a vehicle may be an air, sea, or land vehicle, and the present disclosure will refer to aircraft for ease of description, but is not limited thereto.

In many tactical situations, the military wants to fly a bombing mission, return to base, quickly re-load with more bombs, and fly again. However, known gas supply systems and store ejection mechanisms, such as pneumatically powered bomb racks, prevent quick mission turn-around of tactical aircraft. For example, in conventional systems, aircraft must wait until an on-board compressor, for compressing the gas used to actuate the store ejector mechanisms, recharges a gas-supply system. Existing gas supply systems rely only on an onboard recharging system, and due to compressor size, cannot recharge the system in a short time. In addition, existing systems require manual resetting of system components, which also increases turn-around time.

Further, existing systems fail to perform equally well under varied environmental conditions, and may undesirably vary the time to release a store at, for example, different temperatures and air pressures.

Accordingly, there is need for a gas supply system that can operate to desired specifications under all environmental conditions, and that provides for automatic resetting of system components and high flow output from replaceable, refillable and reusable gas storage vessels.

SUMMARY OF THE INVENTION

Embodiments of the present invention provide a self contained, fast acting, high flow gas supply system for pneumatic store ejection that utilizes an easily replaceable gas storage vessel, and that allows for quick mission turn-around.

A gas supply system, in accordance with an embodiment of the present invention, comprises a receiver assembly, a gas storage vessel coupled to the receiver assembly, a main poppet positioned at an end of the gas storage vessel and sealing the gas storage vessel when the main poppet is closed, a pilot poppet positioned in the main poppet and sealing the gas storage vessel when the pilot poppet is closed, and a chamber positioned behind the main poppet, wherein when the pilot poppet opens, gas from the gas storage vessel is released into the chamber to exert pressure on the main poppet to open the main poppet.

The main poppet moves into the gas storage vessel into a pressure stream of escaping gas from the gas storage vessel to open the main poppet. The escaping gas flows through a port to a store ejection mechanism.

The pilot poppet moves into a pressure stream of escaping gas from the gas storage vessel to open the pilot poppet.

A first end of the main poppet located at the chamber has a larger diameter than a second end of the main poppet located at the end of the gas storage vessel. A plunger positioned behind the main and pilot poppets pushes the pilot poppet into a pressure stream of escaping gas from the gas storage vessel to open the pilot poppet. Prior to actuation, the plunger is held in a retracted position by a trigger sear linkage, which is actuated by a solenoid.

The gas storage vessel can be coupled to the receiver assembly by screwing the gas storage vessel into the receiver assembly, and may be is pressurized prior to being coupled to the receiver assembly. A time for the main poppet to move into the gas storage vessel to reach a stop cam be less than or equal to about 20 ms.

The main poppet includes a seal to plug an orifice in the gas storage vessel, and the pilot poppet includes a seal to plug an orifice in the main poppet.

The system may include a sequencing valve, wherein the sequencing valve opens a vent to atmosphere for one side of the main poppet.

A method for supplying gas to a store ejection mechanism, in accordance with an embodiment of the present invention, comprises coupling a pressurized gas storage vessel to a receiver assembly, positioning a main poppet at an end of the gas storage vessel to seal the gas storage vessel when the main poppet is closed, positioning a pilot poppet in the main poppet to seal the gas storage vessel when the pilot poppet is closed, pushing the pilot poppet toward the gas storage vessel into a stream of escaping gas from the gas storage vessel to open the pilot poppet and to fill a chamber positioned behind the main poppet with the escaping gas, and exerting pressure on the main poppet with the escaping gas to push the main poppet into the gas storage vessel to open the main poppet.

The main poppet moves into the gas storage vessel against a pressure stream of escaping gas from the gas storage vessel. A first end of the main poppet located at the chamber has a larger diameter than a second end of the main poppet located at the end of the gas storage vessel. A plunger positioned behind the main and pilot poppets pushes the pilot poppet toward the gas storage vessel.

A solenoid can be energized to actuate a trigger sear linkage to release the plunger from a retracted position. The main poppet may include a seal to plug an orifice in the gas storage vessel. The pilot poppet may include a seal to plug an orifice in the main poppet.

The method may further comprise opening a vent to atmosphere for one side of the main poppet.

A gas supply system for store ejection from a vehicle, in accordance with an embodiment of the present invention, comprises a receiver assembly, and a gas storage vessel removably coupled to the receiver assembly, wherein the receiver assembly includes a port for connecting to a pressurized gas source on-board the vehicle, the port is connected to the gas storage vessel, and the gas storage vessel is refilled with pressurized gas via the port.

A seal may be positioned between the gas storage vessel and the port, wherein the seal functions as a poppet seat. The pressurized gas source may be a compressor.

BRIEF DESCRIPTION OF THE DRAWINGS

Exemplary embodiments of the present invention will be described below in more detail, with reference to the accompanying drawings, of which:

FIG. 20 is a right side sectional view of the gas supply system illustrating a plunger retraction mechanism, according to an embodiment of the present invention.

DETAILED DESCRIPTION OF EXEMPLARY EMBODIMENTS

Figure 1:
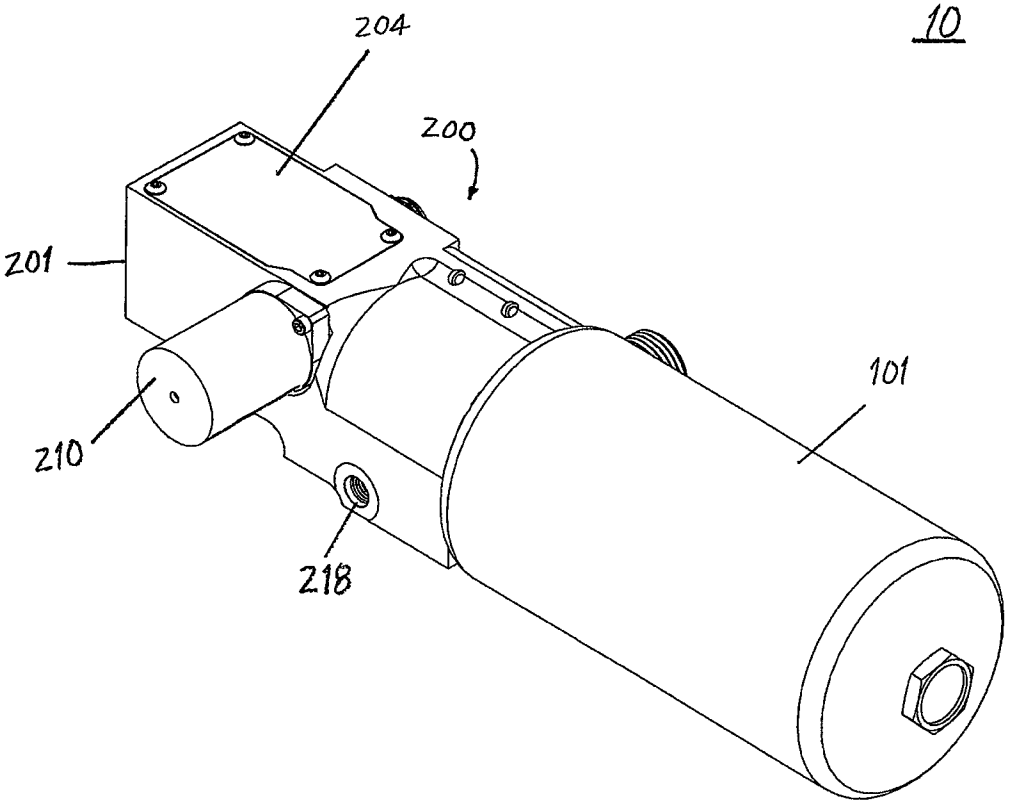
FIG. 1 is a perspective view of a gas supply system including a gas storage vessel and a receiver assembly, according to an embodiment of the present invention.
Figure 2:
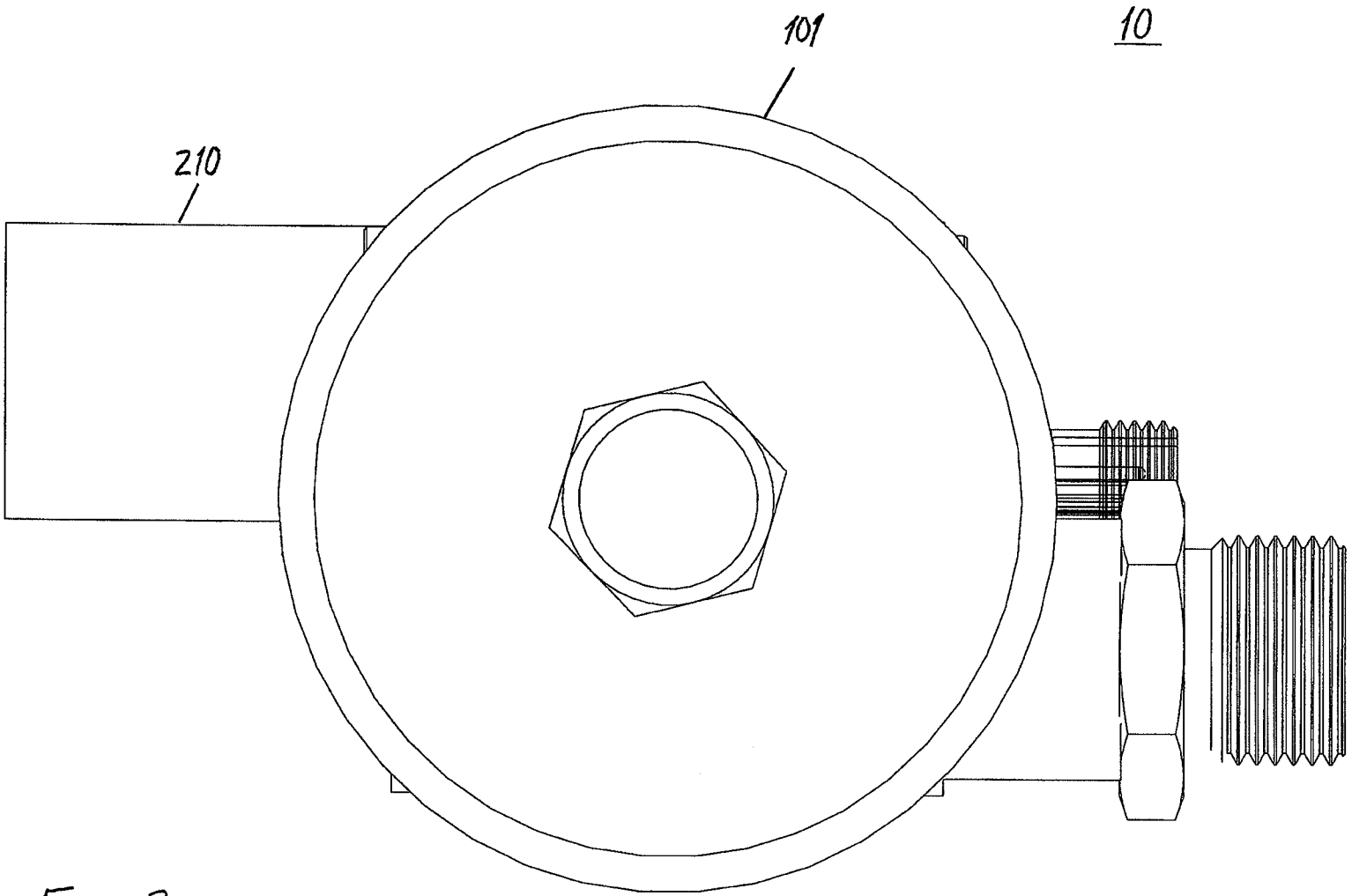
FIG. 2 is a front view of the gas supply system, according to an embodiment of the present invention.
Figure 3:
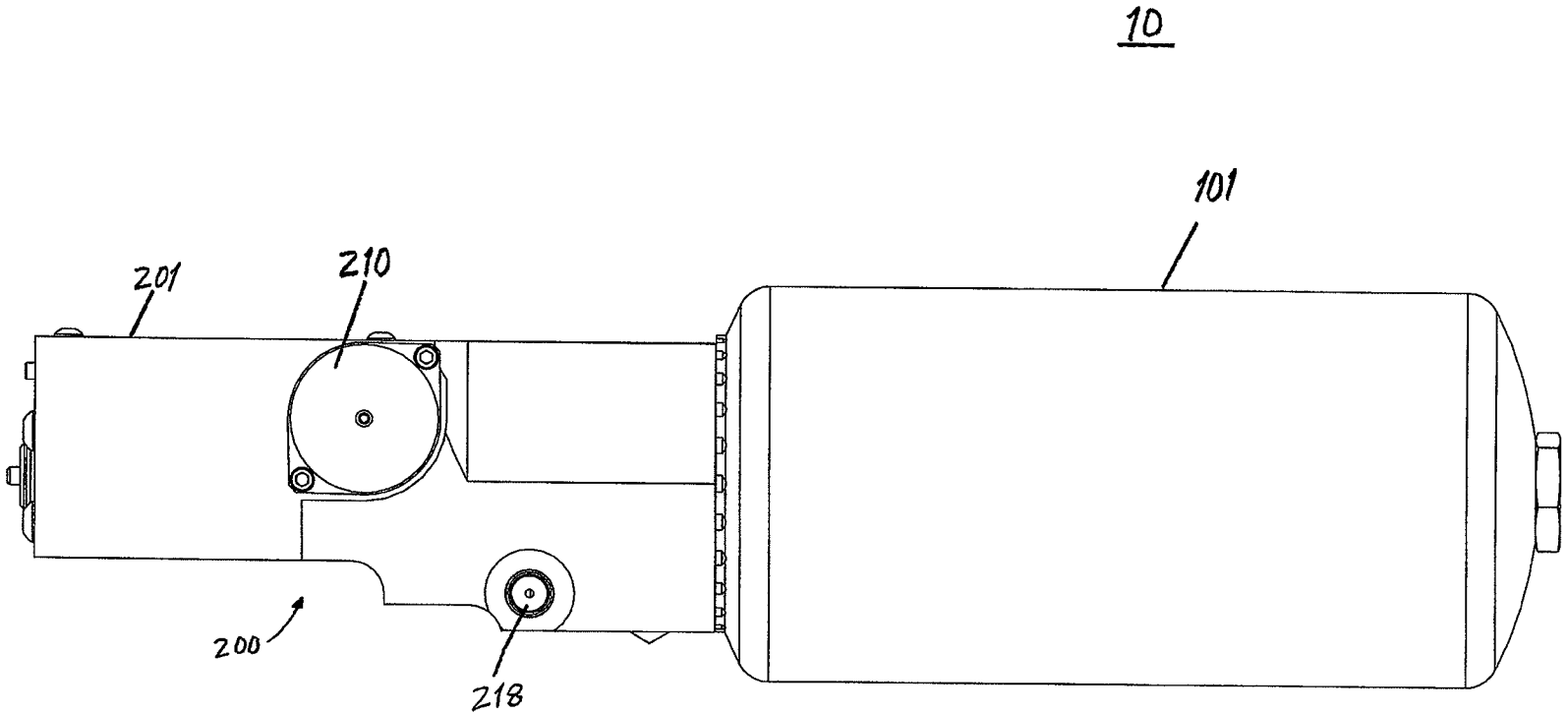
FIG. 3 is a right-side view of the gas supply system, according to an embodiment of the present invention.
Figure 4:
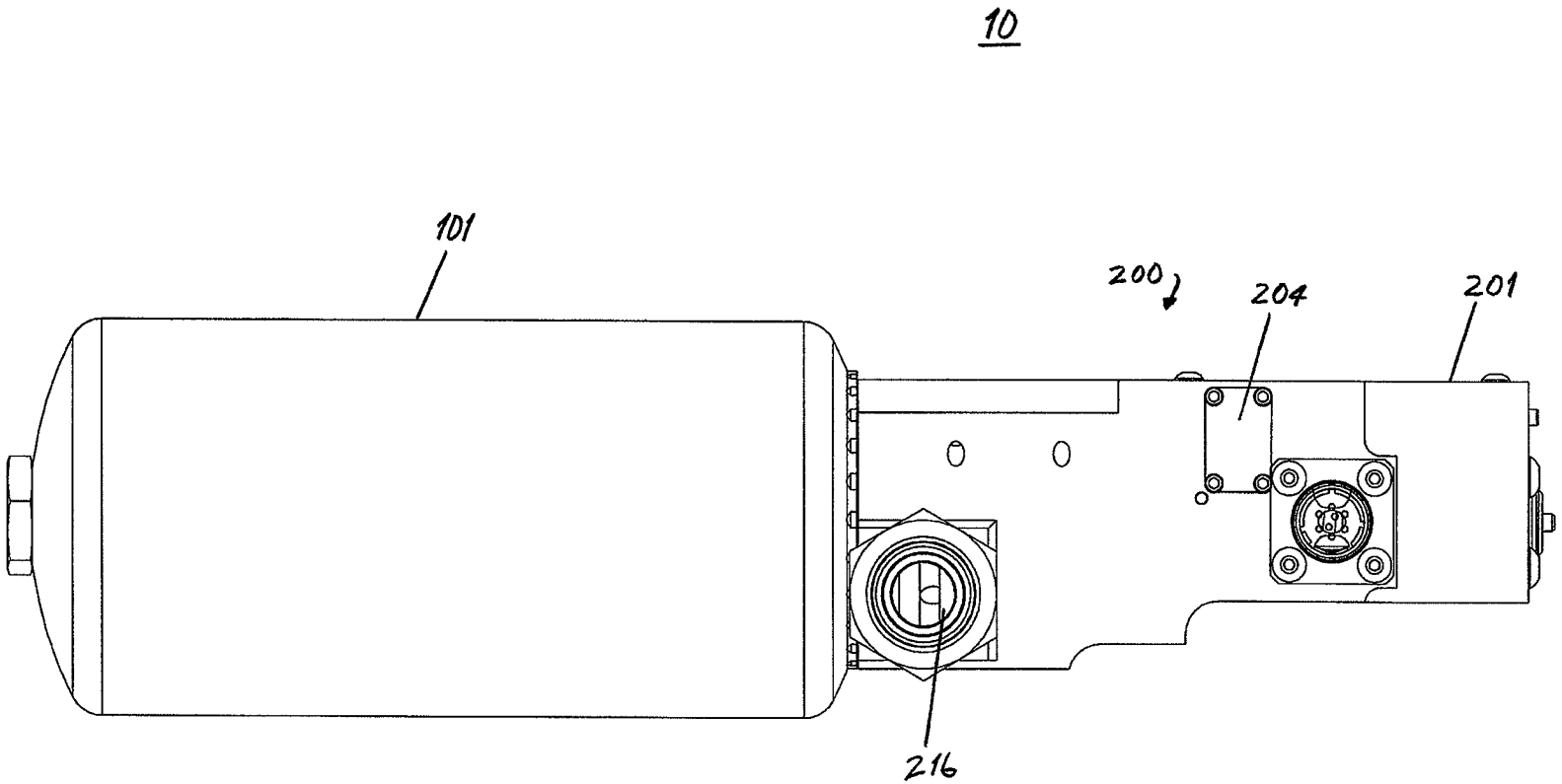
FIG. 4 is a left side view of the gas supply system, according to an embodiment of the present invention.
Figure 5:
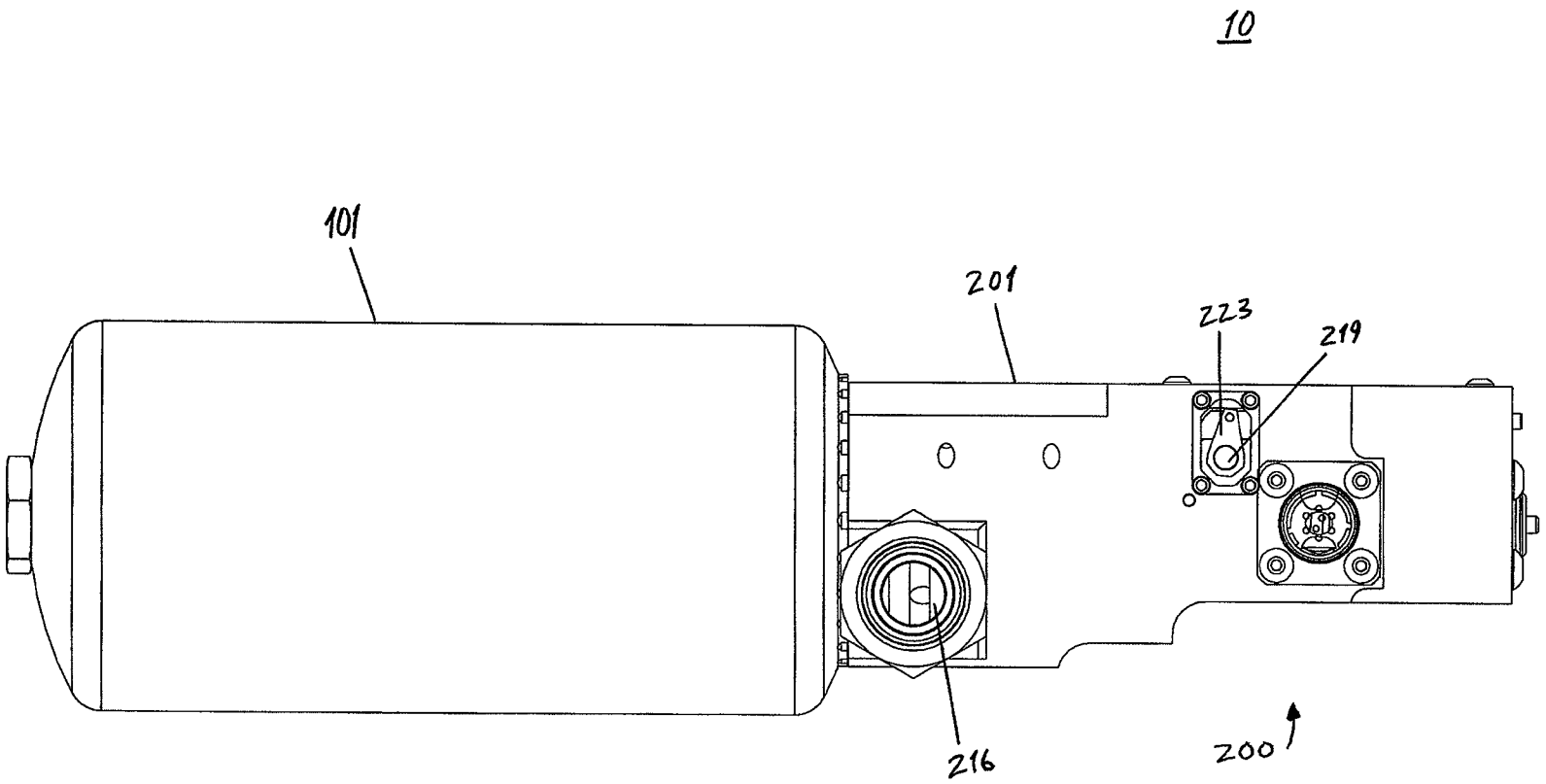
FIG. 5 is a left-side view of the gas supply system with an access panel removed to show a shaft and bell-crank, according to an embodiment of the present invention.
Figure 6:
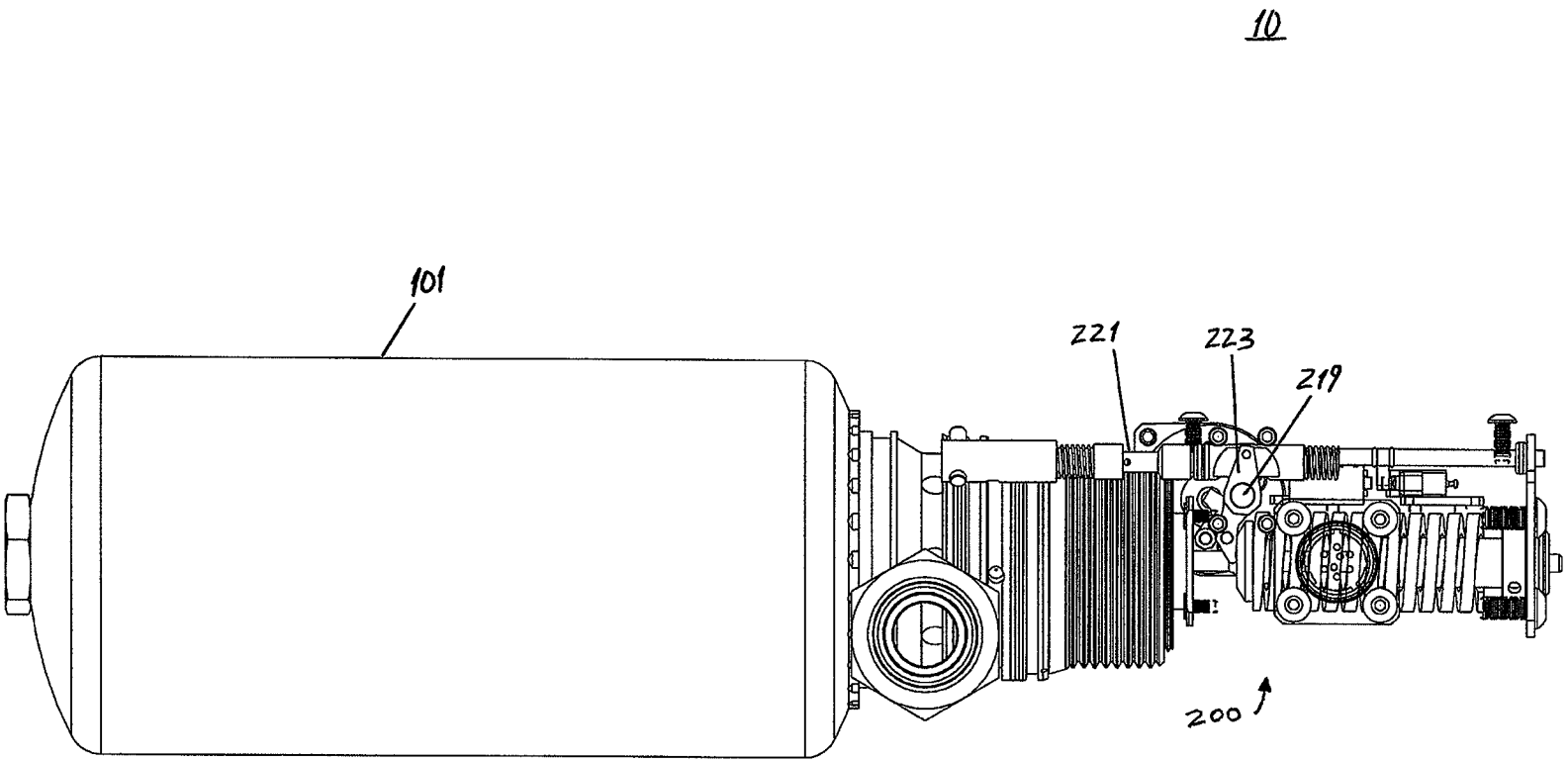
FIG. 6 is a left-side view of the gas supply system with a receiver assembly housing removed to show a sequencing valve, according to an embodiment of the present invention.
Figure 7:
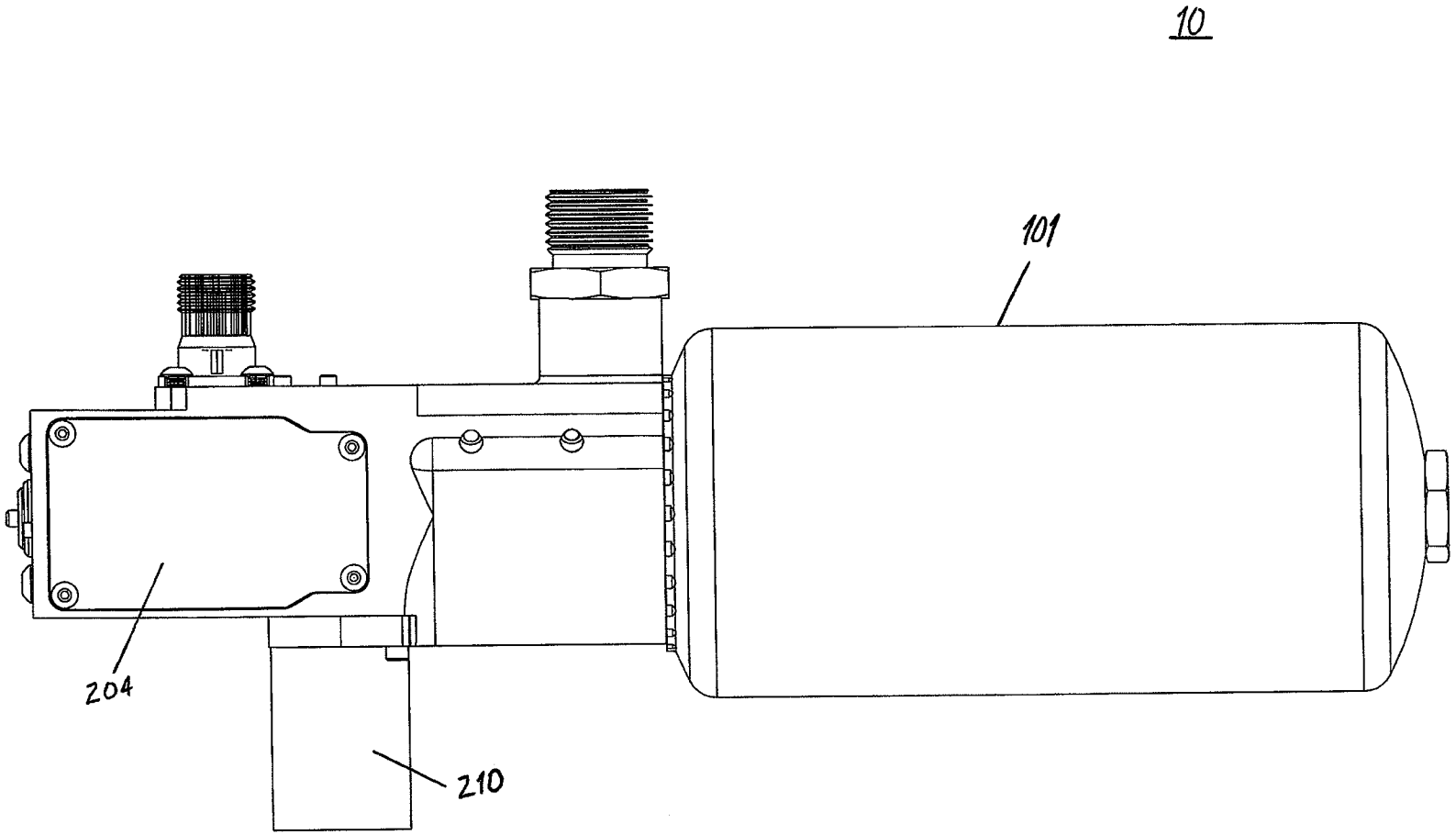
FIG. 7 is a top view of the gas supply system, according to an embodiment of the present invention.
Figure 8:
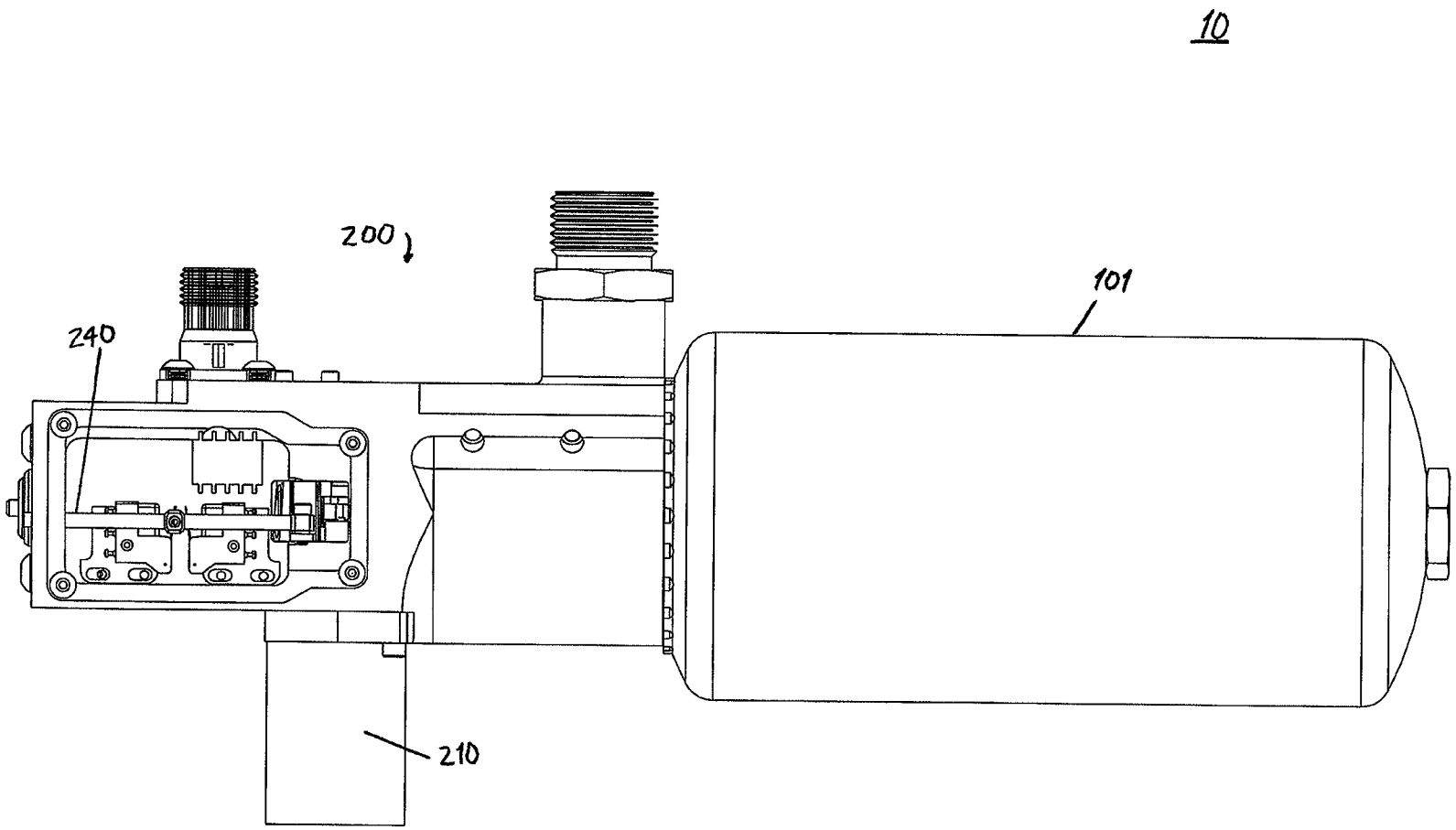
FIG. 8 is a top view of the gas supply system with an access panel removed to show a switch actuator rod, according to an embodiment of the present invention.
Figure 9:
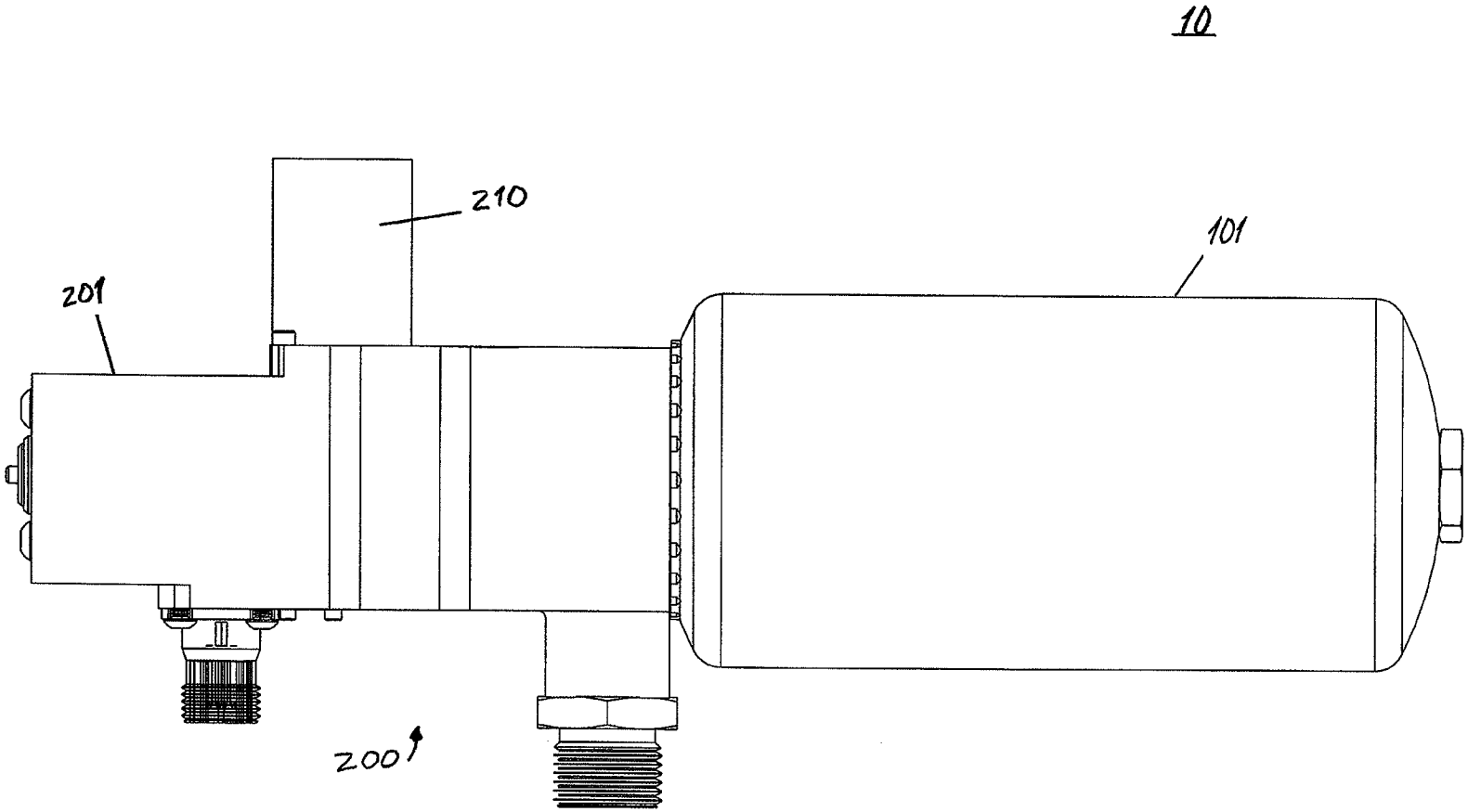
FIG. 9 is a bottom view of the gas supply system, according to an embodiment of the present invention.
Figure 10:
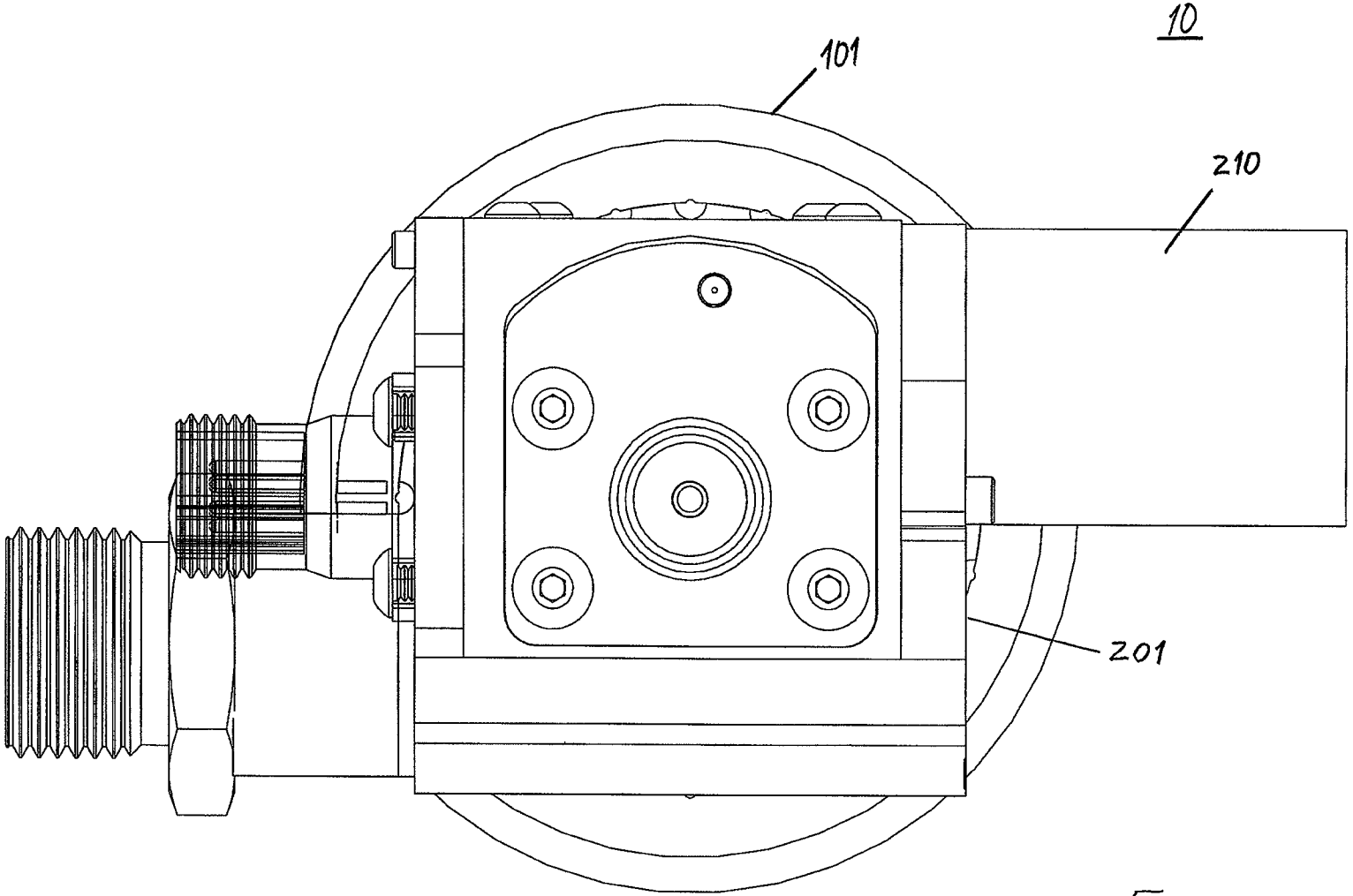
FIG. 10 is a rear view of the gas supply system, according to an embodiment of the present invention.
Figure 11:
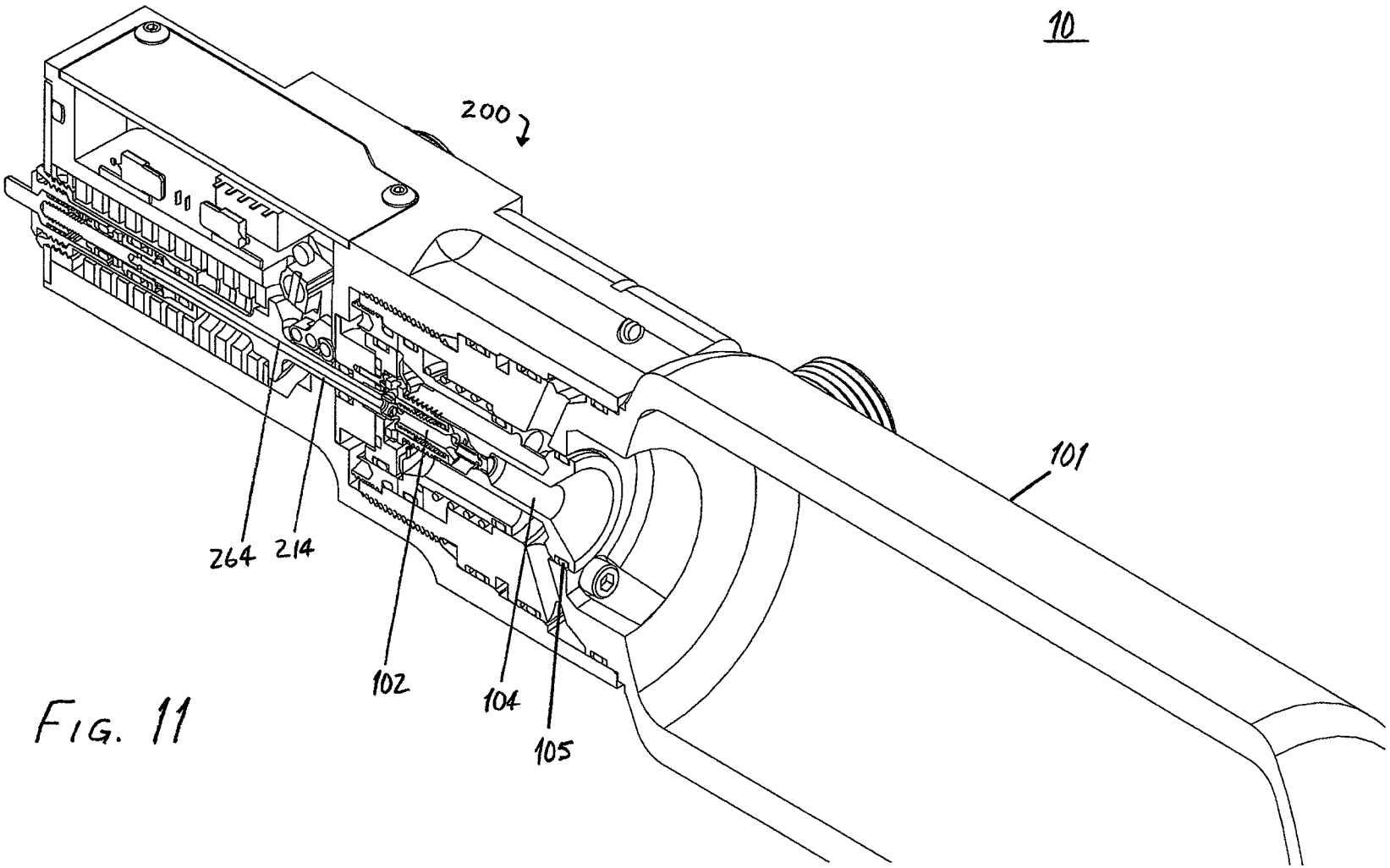
FIG. 11 is a perspective sectional view of the gas supply system prior to actuation, according to an embodiment of the present invention.
Figure 12:
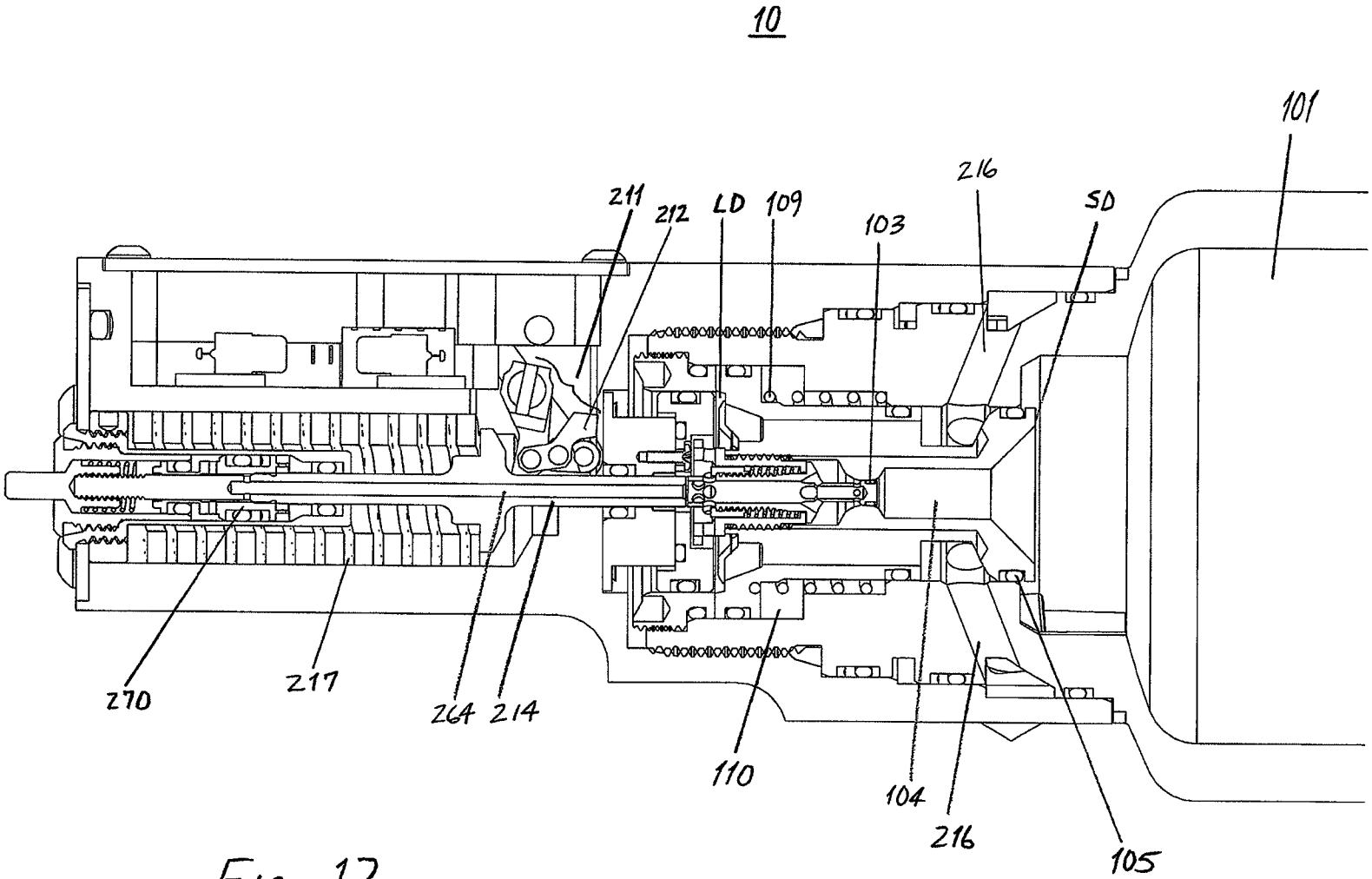
FIG. 12 is a right side sectional view of the gas supply system prior to actuation, according to an embodiment of the present invention.
Figure 13:
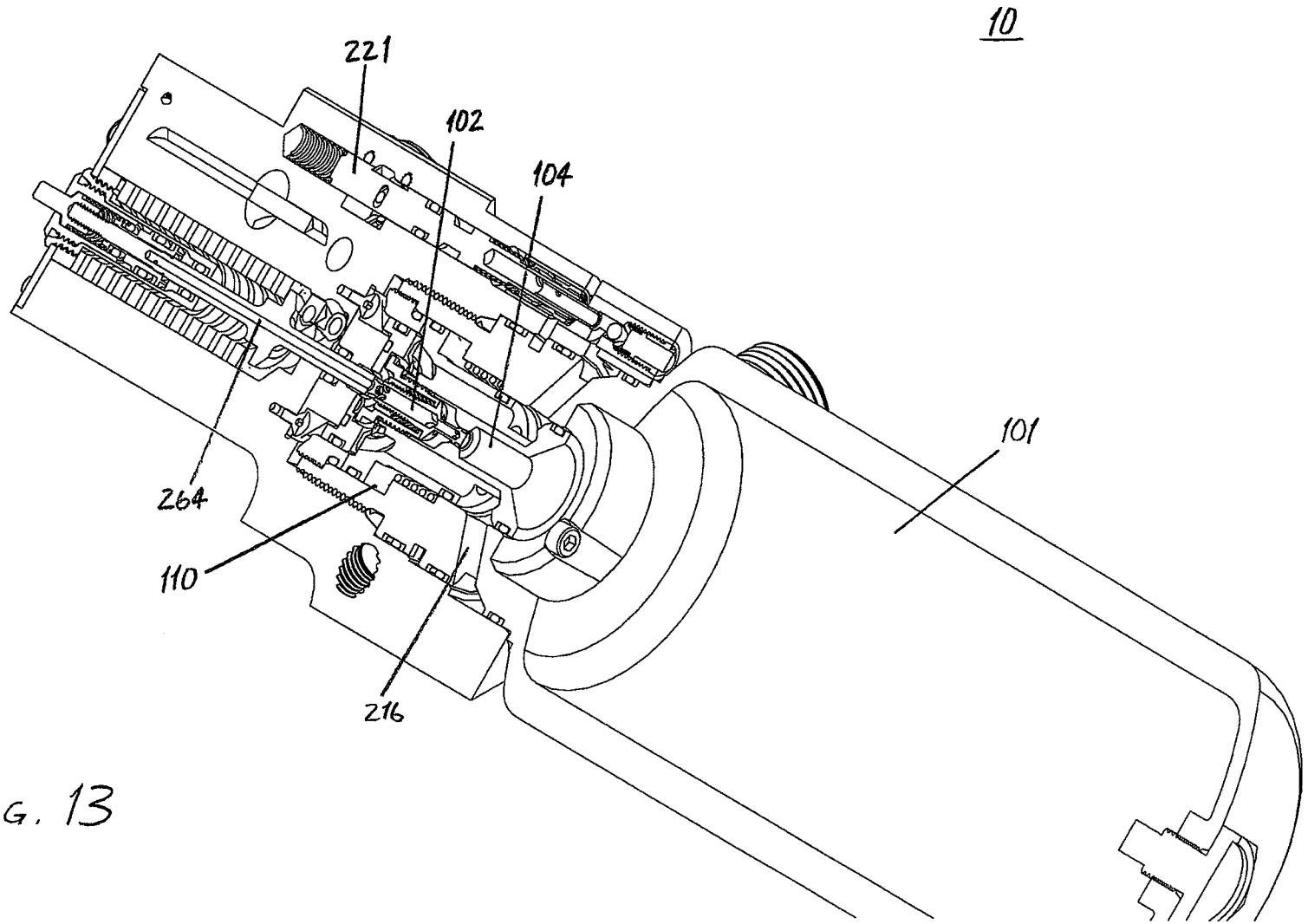
FIG. 13 is a perspective sectional view of the gas supply system prior to actuation and showing a sequencing valve, according to an embodiment of the present invention

Exemplary embodiments of the present invention now will be described more fully hereinafter with reference to the accompanying drawings. This invention may, however, be embodied in many different forms and should not be construed as limited to the embodiments set forth herein.

Turning now to FIGS. 1-18, a gas supply system 10 is shown. The gas supply system includes a gas storage vessel (GSV) 101, and a receiver assembly 200. The GSV 101 is replaceable and is configured to screw into the receiver assembly via, for example, an MS port thread. A detent mechanism may be employed to prevent the GSV 101 from loosening from the receiver assembly 200.

The GSV 101 can be made of, for example, stainless steel, and may include a pressure gauge. The pressure gauge may include a built in overpressure venting system (not shown) that will prevent explosive bottle failure in case of fire or other causes of dangerously excessive pressure. The venting system may include, for example, a relief valve.

The receiver assembly includes a housing 201, which includes access panels/covers 204. In some of the views, for example, FIGS. 5, 6, and 8, the access panels/covers 204 and/or the housing 201 have been removed to illustrate some of the inner components of the receiver assembly 200.

All receiver assembly components are housed in the housing 201 and protected from environmental contamination by the access covers 204. The receiver assembly 200 provides pneumatic and electrical connections to the aircraft. For example, the electrical connections receive operating power from, provide gas supply system status to, and receive the launch command(s) from, the aircraft weapons control system. A compressor port 218 connects to the output of an on-board compressor (not shown) to optionally perform a recharging operation of the GSV 101. The port 218 may be connected to an internal check valve in the GSV 101. The pneumatic outlet port 216 connects to the pneumatic inlet on the bomb rack or other store supporter, so that the pressurized gas may operate the store ejection mechanisms of the bomb rack.

The interface between the receiver assembly and the GSV 101 assemblies provides connection for individual, isolated passages between the GSV 101 and the receiver assembly 200. A first passage connects, when actuated, the gas stored in the GSV 101 to the receiver assembly 200 and ultimately, the outlet port 216. A second passage connects the control chamber 110 in the GSV 101 to a sequencing valve 220 (discussed below). A third passage connects the compressor port 218 to a GSV inlet check valve.

In a normal pre-flight check of the system, the pressure gauge on the GSV 101 is checked to insure that the GSV 101 has the specified pressure to operate the bomb rack. If not yet installed, the GSV 101 is screwed into the receiver assembly mounting thread until it is fully seated (e.g., hand tight). A protruding pin may be positioned on the back of the receiver assembly 200, allowing a visual and/or tactile status check without powering up the aircraft. For example, if a valve actuating system of the receiver assembly is properly armed, the pin protrudes from the housing 201 of the receiver assembly. Conversely, if the valve actuating system of the receiver assembly is not properly armed, the pin will not protrude, signaling that the GSV 101 may have been depleted. The receiver assembly 200 can be re-armed manually and the GSV 101 can be replaced or re-charged.

Gas is stored in the GSV 101, and is released upon actuation of a gas release pilot poppet 102 and a main poppet 104. Low leakage seals 103, 105 and 108 allow long term storage of gas in the charged vessel 101. For example, the GSV 101 may have a 10 year storage life without significant loss of gas pressure. The pilot poppet 102 includes the seal 103 and a back-up ring (not visible in the drawings) positioned in O-ring groove 103*g*, and the main poppet 104 includes seal 105 and a back-up ring 105*b* positioned in O-ring groove 105*g*. The seals and back-up rings, which are made of, for example, rubber, provide a very low leakage seal and plug an orifice in the main valve poppet 104. Since the seals 103 and 105 are pushed into the pressure source and held in the O-ring grooves by the pressurized gas leaving the GSV 101, the seals 103 and 105 are able to perform a dual function of sealing the GSV 101, while also acting as a poppet seats.

Seal 108 is low leakage poppet style check valve seal. Like the seals 103 and 105, the seal 108 is pushed into a pressure source (e.g., pressurized gas coming from a compressor) and held in an O-ring groove by the pressurized gas leaving the pressure source. Like the seals 103 and 105, the seal 108 is able to perform a dual function of sealing, and also acting as a poppet seat. The check valve poppet seal 108 is formed in a conduit 237, which leads to a passage 238 that connects to compressor port 218.

Referring, for example, to FIGS. 11-14, prior to actuation, a plunger 214, which is biased by a spring 217, is held in place by a trigger sear linkage 211. At this point, a pilot valve poppet 102 and a main valve poppet 104 are closed so that no gas is released from the GSV 101.

A command, for example, a bomb drop command from inside the aircraft, is relayed to a solenoid 210, which actuates the trigger sear linkage 211 to release the spring loaded plunger 214. The plunger 214 is held in the retracted position by a trigger linkage 212 that is in turn held in position by a sear linkage and a sear pin that is moveable along its axis. The sear pin is attached to the triggering solenoid 210, but is held in the extended position by a solenoid return spring. This trigger sear linkage 211 holds the plunger 214 retracted until the solenoid 210 is energized.

Upon the launch command, the solenoid 210 is energized, the sear pin retracts, compressing the solenoid return spring, allowing the sear linkage to fold and the plunger 214 to extend, contacting the pilot poppet 102, compressing the pilot poppet return spring 107, and forcing the GSV main poppet 104 forward into the storage vessel 101.

A switch actuator rod 240 is connected to the top of the sear link. The switch actuator rod 240 is part of the electrical control and monitoring system and actuates an electrical switch at each end of the plunger movement. As the plunger 214 begins its extension, the now rotating sear link pushes the switch actuator rod 240, activating a first switch, which energizes a small relay, which in turn removes electrical power from the triggering solenoid 210. The solenoid 210, now de-energized allows the solenoid return spring to extend the sear pin to the side of the sear linkage. Since the sear has already been released, the sear pin simply rests against the side of the sear linkage until the sear linkage and plunger retract.

The spring loaded plunger 214 presses pilot valve 102 inward toward the stored gas pressure, releasing a small amount of high pressure gas into chamber A, which is a closed cavity. The increased pressure in chamber A, which is positioned behind the main valve poppet 104, then acts on the main poppet 104 to push the main poppet 104 inward into the GSV 101 toward the pressure. As a result, the main valve opens, and pressurized gas is released to discharge port 216. From discharge port/outlet fitting 216, the gas travels to the store ejection mechanism to release the store.

Standard O-ring seals 103 & 105 can be used for low leakage valve design. Because the main valve poppet 104 is pushed into the pressure stream from the GSV 101, the O-rings are not forced off, and instead, are held in place by the pressurized gas. In other words, by pushing the poppets 102 and 104 into the pressure source 101, the soft rubber seals 103 and 105 are not stripped from the poppets by the pressure. Use of a soft rubber seal 103/105 allows very low leakage rates, which provides very long storage life, while still allowing quick release of the gas.

According to an embodiment, the main valve poppet 104 has three sets of very low leakage seals with back-up rings, made from, for example, rubber. The main poppet 104 plugs, with a first set of seals 105 and back-up rings 105*b*, a much larger orifice relative to the pilot valve port directly in the storage vessel 101. A second set of seals 130 and back-up rings 130*b* with the same diameter as the first set prevents leakage of released gas to the control chamber 110 of the main poppet 104. On the other end of the main valve poppet 104 are a piston and the third set of seals 140 and back-up rings 140*b* that is about 25% larger in diameter than the first two sets. The main and pilot poppet assembly is retained against vessel pressure by a nut.

The main valve poppet 104 has a stepped diameter. A smaller diameter end SD seals the GSV 101 and a larger diameter end LD seals against chamber A. According to an embodiment, the larger end is about 25% than the end where the seals 105 are located. However, it is to be understood that the ratio of the larger diameter end LD to the smaller diameter end SD may vary depending on different applications, so long as the difference in size in large enough to overcome seal friction and spring force, and push the poppet into the gas source.

More specifically, the gas released by the pilot valve 102 gathers in chamber A and is trapped against this larger diameter of the main valve poppet 104. The larger area due to the larger diameter overcomes the force of the stored gas and the main poppet spring, which can also be used to bias the poppet 104 closed, and forces the poppet 104 inward into the GSV 101. The difference in diameter causes the poppet 104 to move very quickly. For example, approximately 20 milliseconds (ms) or less than 20 ms elapse from actuation of plunger 214 to the high volume release of the stored gas into the outlet fitting 216. The 20 ms period is fast enough so that any increase in the time to more than 20 ms, from plunger actuation to release of stored gas due to environmental conditions, is inconsequential to the overall performance of the system and resulting store ejection.

With the pilot poppet 102 depressed by the plunger 214, high pressure gas starts escaping from the GSV 101 and into chamber A. Gas pressure quickly rises in chamber A and begins acting upon the large diameter end LD of the main valve poppet 104. Since there is a large difference in the area of the large diameter end (piston end) of the main valve poppet 104 versus the end SD plugging the outlet of the GSV 101, the main poppet 104 is forced into the vessel 101, compressing the main valve spring 109, and opening the main valve piston ports to the stored gas. As the main poppet 104 begins to open, the main poppet seal 105 moves off the mating surface of the GSV 101. High pressure gas from the GSV 101 travels down connecting ports in the main poppet 104, opening an accelerator check valve, and instantaneously filling a cavity connected to discharge port 216. At this point, the main poppet 104 quickly travels inward into the GSV 101 to its stop, and less than 20 ms or about 20 ms have elapsed.

The larger diameter end LD of main valve poppet 104 is also sealed against the control chamber 110.

Figure 15:
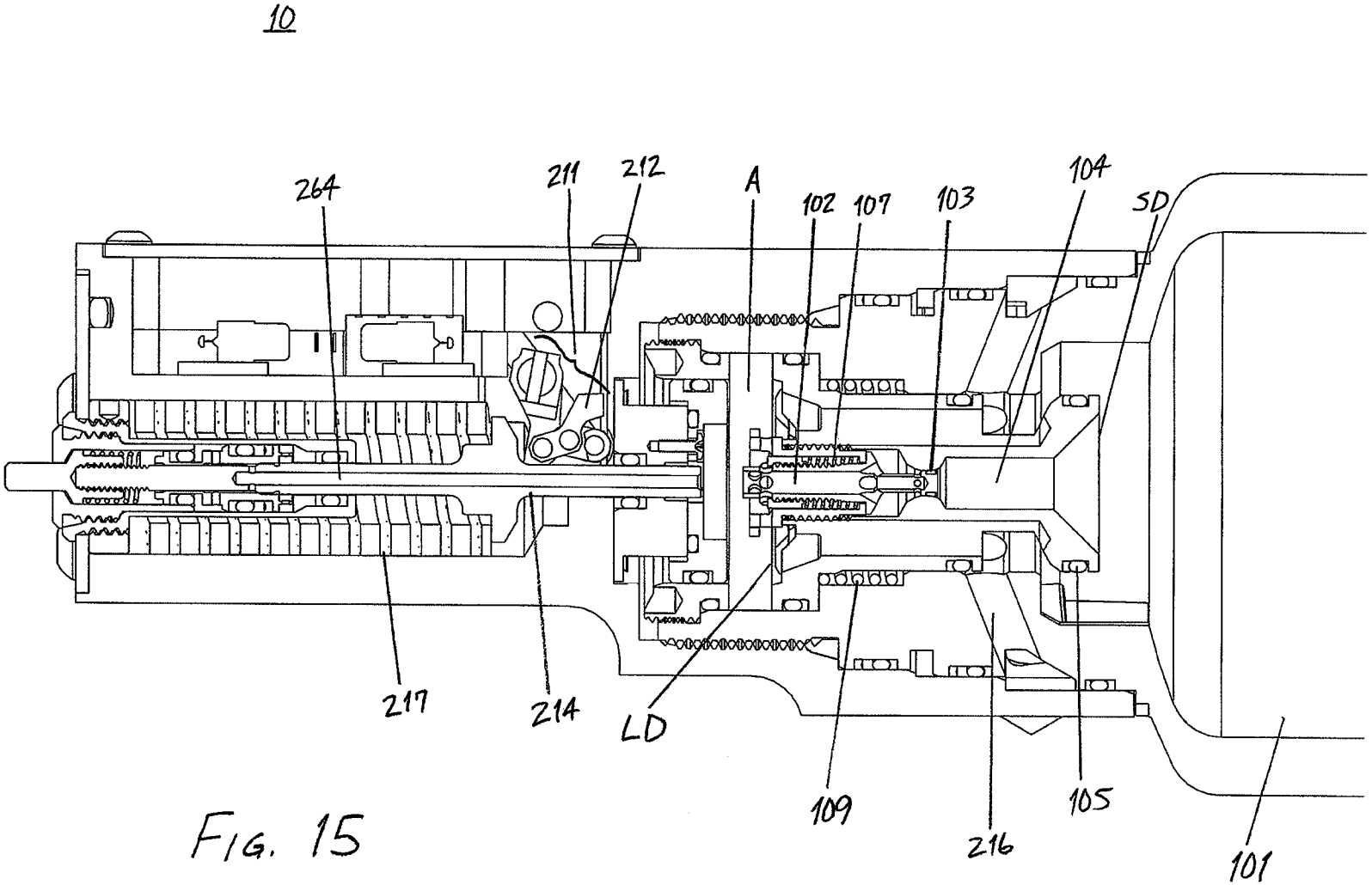
FIG. 15 is a right side sectional view of the gas supply system after actuation, with an open main valve, according to an embodiment of the present invention.

Referring to FIG. 15, after actuation, the plunger 214 retracts, and includes a mechanism that uses a small portion of the released gas to re-cock the plunger 214 and reset the trigger sear release linkage 211 for the next release. More specifically, after actuation, the plunger 214 follows the pilot poppet 102 and main poppet 104 as they retract into the GSV 101. A small amount of high pressure gas from the rapidly pressurizing cavity connected to the discharge port is directed to a small conduit 264 down the center of the plunger 214. Referring to FIG. 20, pressurized gas enters a stepped diameter piston/reversing valve interface 270, from the back of the plunger 214, which has an area approximately equal to the frontal area of the plunger 214. More specifically, the gas enters into area 271 of the piston 270 through ports 265, and then into area 272 through ports 275. The area 272 is approximately equal to the frontal area of the plunger 214. The differential area of the piston 270 generates a force (i.e., the force from the gas in area 272) that opposes the force from the gas pressure in the cavity and prevents the gas pressure from prematurely forcing the plunger 214 to the retracted position. As the plunger 214 reaches the end of its travel (the main valve poppet 104 almost fully retracted), piston face 273 on the back of the plunger 214 strikes a stationary surface 274 within the receiver assembly and opens pressure to the other side of the opposing piston 270. When the piston face 273 strikes the surface 274, the momentum of the plunger 214 and spring 277 opens a reversing valve. As a result, gas quickly builds pressure in a reversing volume 278. This pressure reverses and multiplies the force on the plunger 214 and quickly retracts the plunger 214. Since the sear pin was previously extended, the sear linkage is once again in a position to restrain the plunger 214 after the launch sequence is completed and gas pressure in the cavity returns to pre-launch atmospheric pressure.

As a result, the plunger 214 can be automatically re-cocked by using the gas in the system, thereby eliminating the need to manually re-cock the plunger. Since the gas used to re-cock the plunger 214 is not available after the launching cycle is completer, automatic re-cocking occurs during the launch cycle. Accordingly, the system must compensate for the plunger retracting during the gas release cycle. In other words, there must be a mechanism in place to keep the main poppet 104 open after the plunger 214 is retracted and re-cocked.

A sequencing valve 220 is used to keep the main poppet 104 in the open position after the plunger 214 is retracted and re-cocked. More specifically, a shaft 219 attached to the sear linkage connects to a bell-crank 223 set behind an access panel 204 on the side of the receiver housing 201. As the linkage follows the plunger 214 forward, the shaft 219 and bell-crank 223 rotate, moving a sequencing valve rod 221, and compressing a light spring 227.

Figure 14:
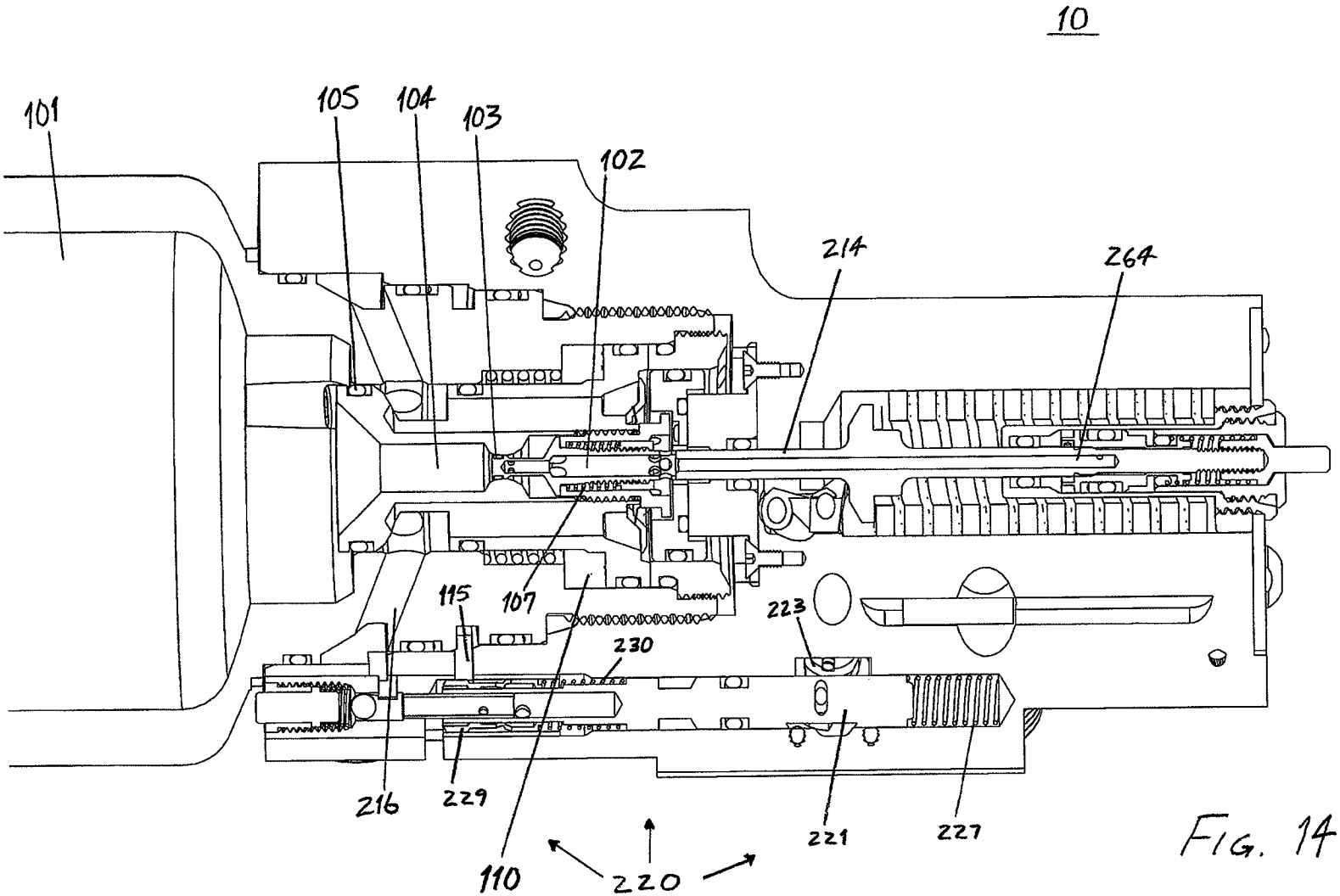
FIG. 14 is a right side sectional view of the gas supply system prior to actuation and showing a sequencing valve, according to an embodiment of the present invention.

For example, referring to FIG. 14, in the pre-actuation position, the sequencing valve rod 221 is in the extended positioned (to the left in the drawing). A sliding valve shroud 229 covers the connecting port 115 to the control chamber 110. At this point, the pilot and main poppets 102, 104 are closed, and the gas in the discharge port 216 is at atmospheric pressure.

Figure 16:
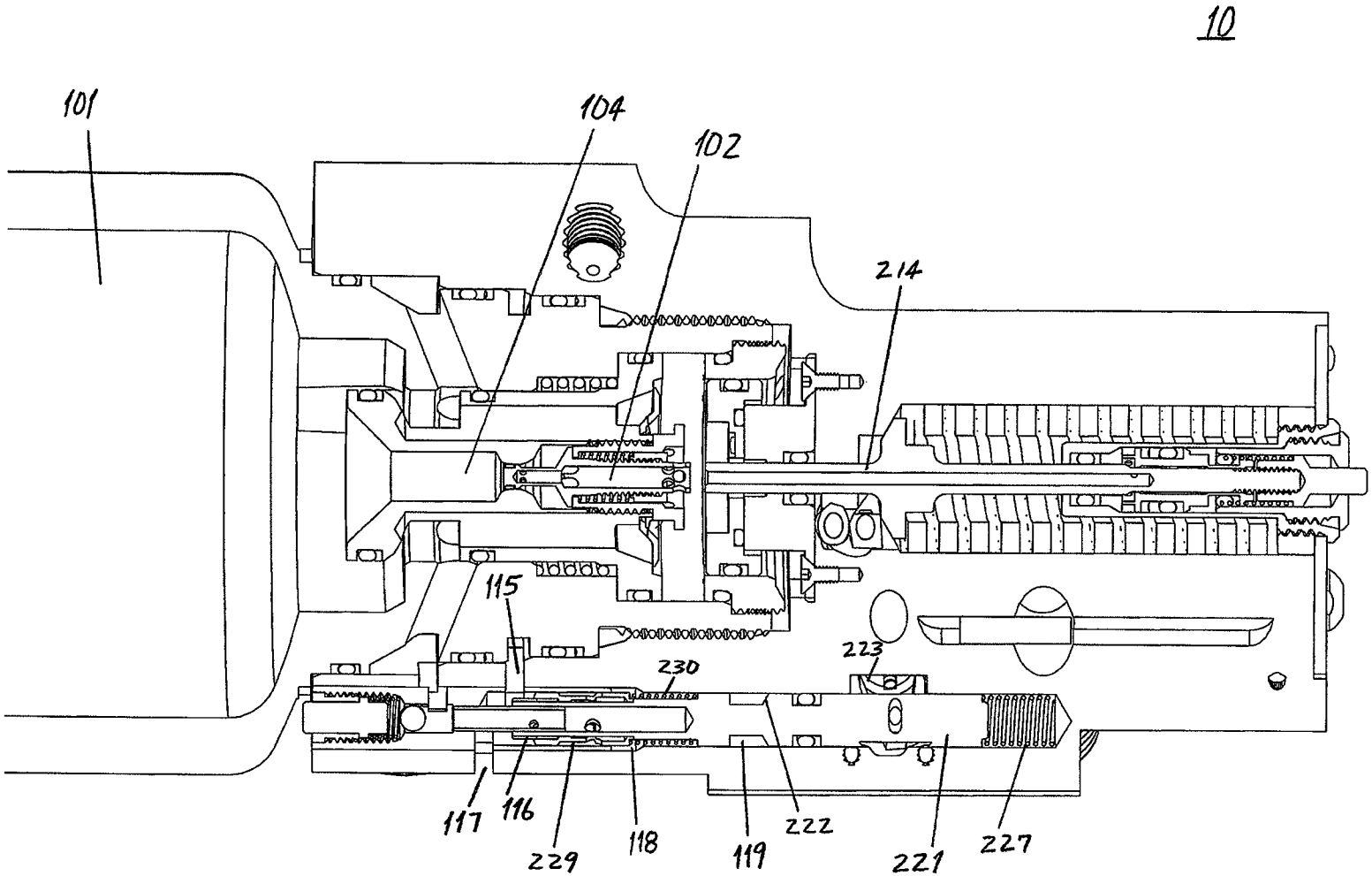
FIG. 16 is a right side sectional view of the gas supply system after actuation, with an open main valve, and showing a sequencing valve, according to an embodiment of the present invention.

Referring to FIG. 16, after actuation, as the sequencing valve rod 221 moves (to the right in the drawing) due to movement of the shaft 219 and rotation of the bell-crank 223, the sliding valve shroud 229 also moves (to the right in the drawing), thereby creating a pathway from port 117 to atmosphere to connecting port 115, so as to connect/vent the main valve control chamber 110 to outside atmosphere.

Pressure (i.e., GSV gas pressure) builds in a trapped volume area 116 to further retract shroud 229 (to the right in the drawing). The pressure to the right of the shroud 229 at area 118 remains at atmosphere. At this point, a pressure differential is created on the main valve poppet 104, whereby the pressure is at atmospheric pressure on one side of the main valve poppet due to the vent to atmosphere, and at gas pressure from the GSV 101 on the other side of the main valve poppet. The pressure differential is in place prior to the retraction of the plunger 214 so that the main valve remains open after the plunger 214 retracts. Once the plunger 214 retracts, the shroud 229 remains open due to the trapped volume in area 116 having high pressure, while pressure on the other side of the shroud 229, at area 118, remains at atmosphere.

As gas pressure is rapidly increasing in the discharge port 216, a port directs a small amount of gas from the discharge port 216 to an opening in the sequencing valve rod 221 aligned with the discharge port 216, and down the rod to the small trapped volume 116 which acts on a piston attached between the sequencing valve rod 221 and the sliding valve shroud 229. This gas retracts the shroud 229 even further, insuring that the GSV main valve control chamber 110 remains at atmospheric pressure during the remainder of the gas delivery event, even though the plunger 214 may have retracted.

Figure 17:
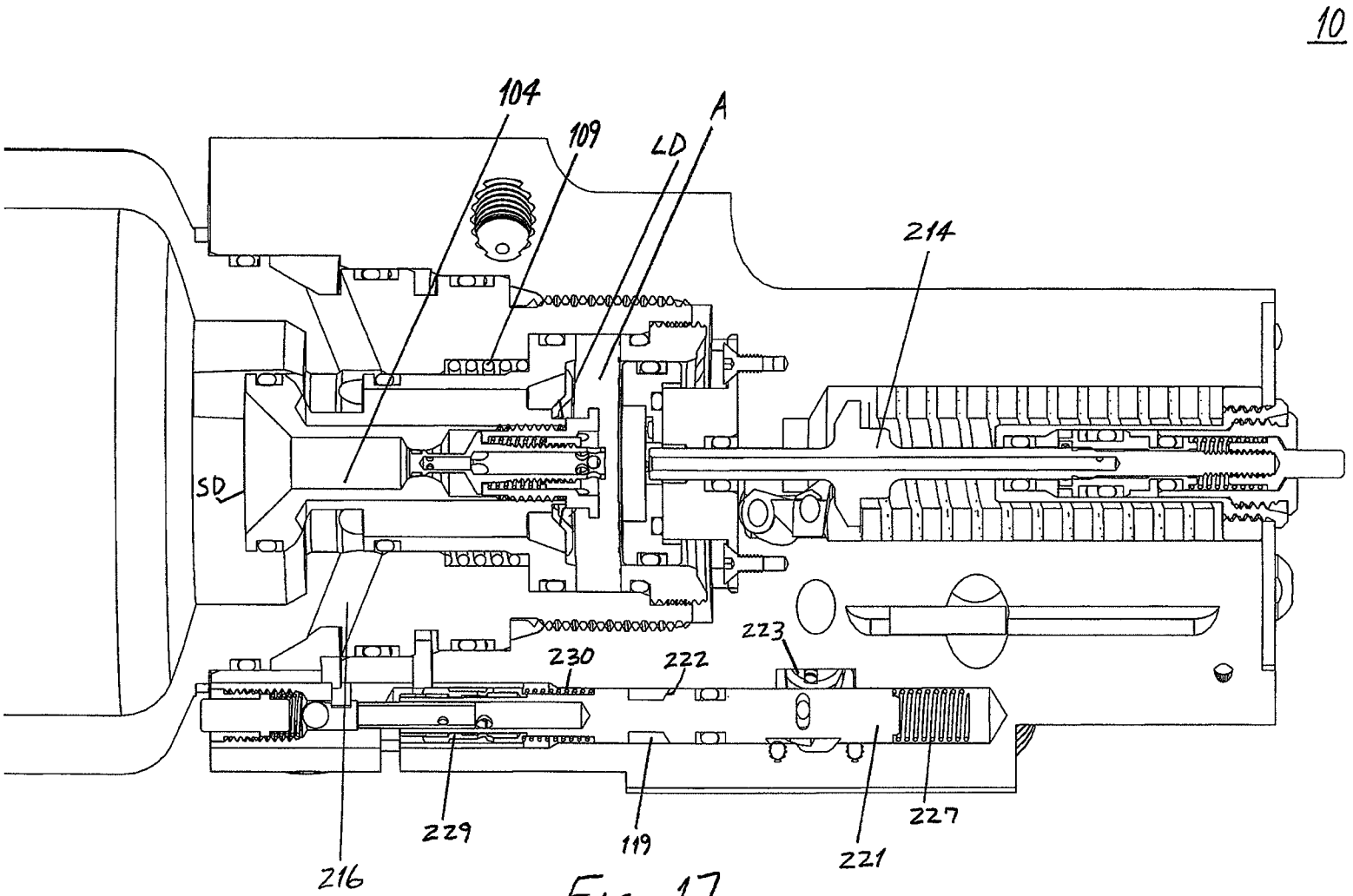
FIG. 17 is a right side sectional view of the gas supply system after actuation, with an open main valve, and showing a sequencing valve, according to an embodiment of the present invention.

Referring to FIG. 17, the plunger 214 has retracted, and gas continues to flow out of GSV 101 through discharge port 216 until the operation of the store ejection mechanism is complete, and then the flow drops to near zero. Although the sequence valve rod 221 extends (back to the left in the drawing) as the plunger 214, retracts, the trapped volume at area 116 keeps the sliding shroud 229 retracted enough to continue to vent the control chamber 110 to atmosphere, thereby keeping the main valve open. At this point, pressurized gas from the system leaks into chamber 119 (to the right of the shroud 229 in the drawing), at least in part due to holes 222 in the sequencing valve rod 221. It is to be understood that in some cases, the control chamber 110 may continue to be vented until well after the launch sequence is completed.

Figure 18:
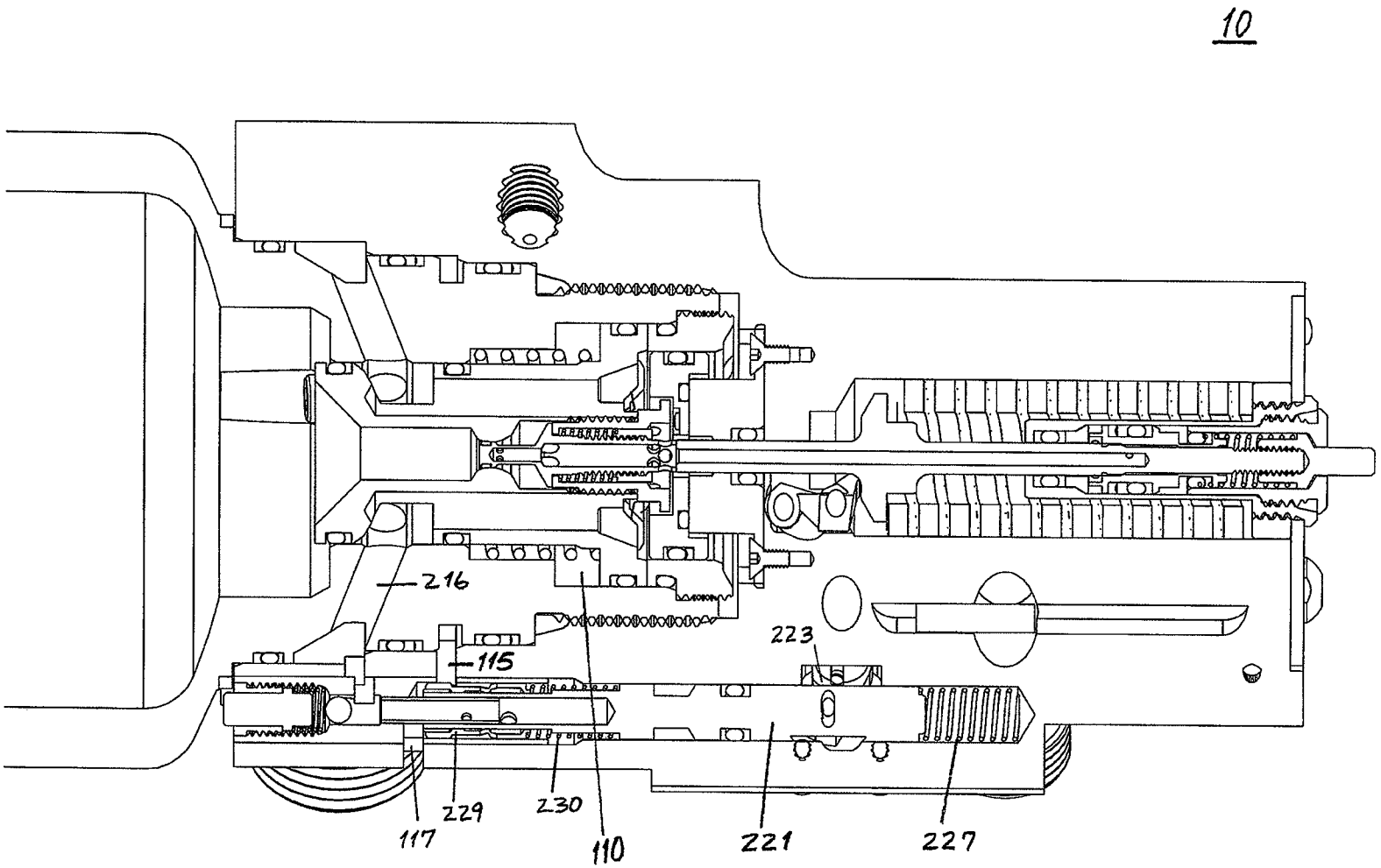
FIG. 18 is a right side sectional view of the gas supply system after actuation, with a closed main valve, and showing a sequencing valve, according to an embodiment of the present invention.
Figure 19:
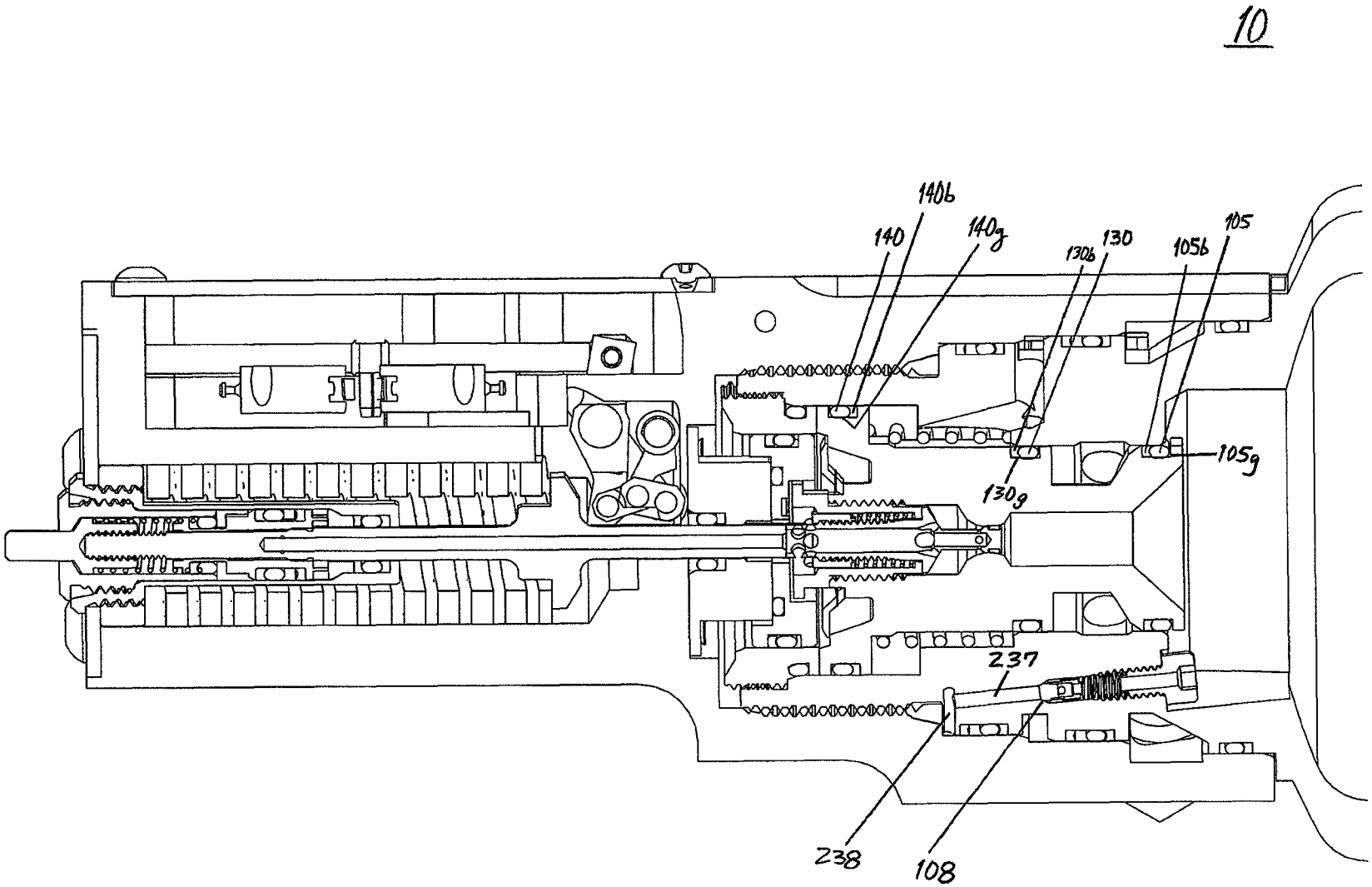
FIG. 19 is a right side sectional view of the gas supply system illustrating seals, according to an embodiment of the present invention.
Figure 2D:
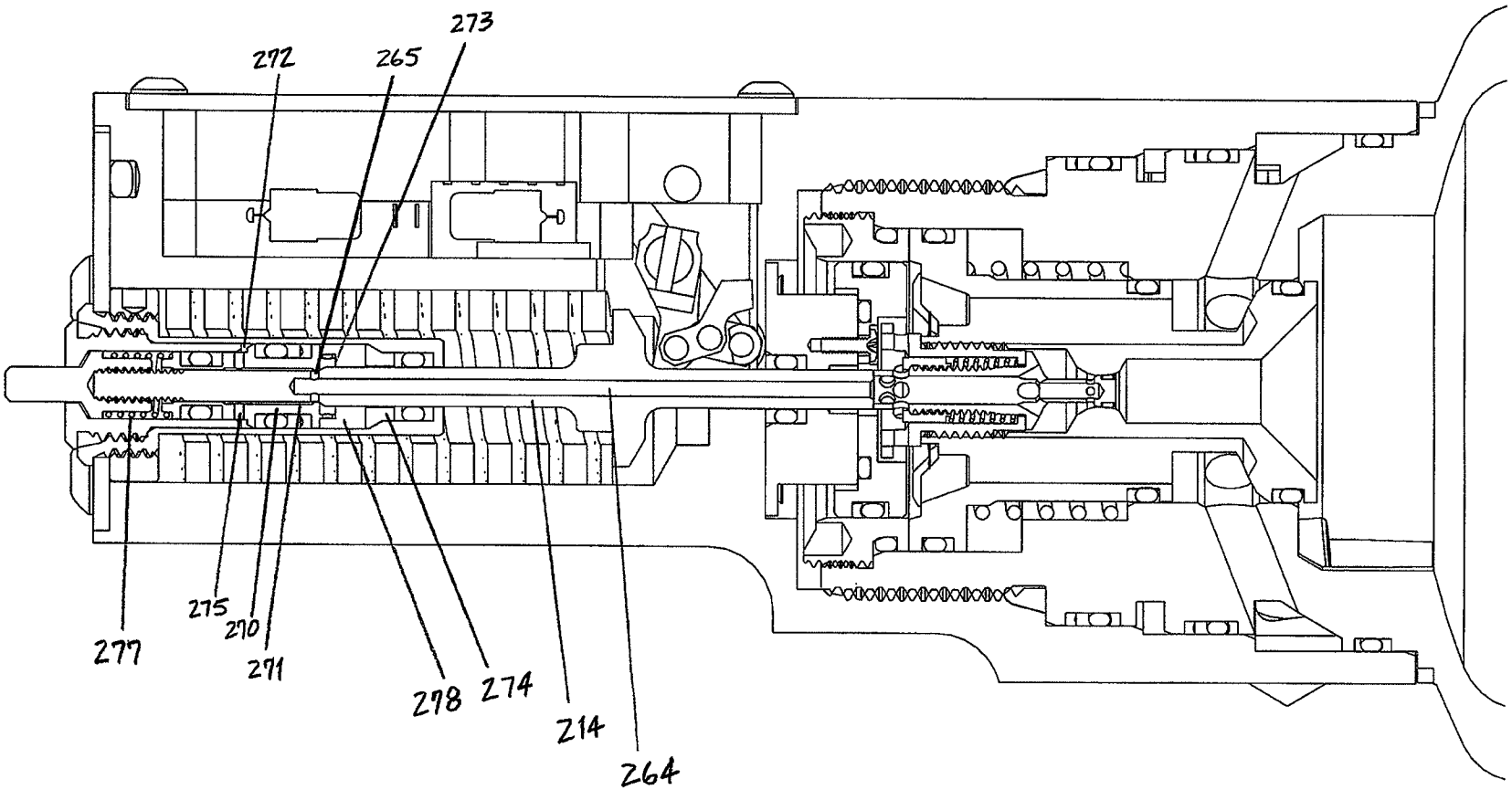

Referring to FIG. 18, due to the pressure increase in chamber 119, bleeding of the trapped volume to atmosphere, and the biased force of shroud spring 230, the shroud 229 is pushed back (to the left in the drawing), thereby blocking the vent to the atmosphere. As a result, the control chamber 110 is re-connected to the discharge port pressure, and pressure in the control chamber increases to above atmosphere to equalize pressure on both sides of the main valve poppet 104 so that the main valve spring 109 can close the main valve. The time for the main poppet 104 to return to its original position and close the main valve can be set so that full drain of gas from the GSV 101 is prevented so that the GSV 101 may be re-used for another bomb drop. Remaining gas in the GSV 101 is saved as pressure downstream of the discharge port 216 bleeds away.

When the shroud 229 shifts, the control chamber 110 is closed to atmospheric pressure by blocking port 115, and then switched to outlet port pressure. With outlet port pressure on both sides of the large piston on the GSV main poppet 104, the poppet 104 closes from the retracted position. This prevents the GSV 101 from losing anymore of the stored gas in the vessel 101. System pressure outside of the bottle 101 now begins to leak out of the system, eventually returning to atmospheric pressure.

Although exemplary embodiments of the present invention have been described hereinabove, it should be understood that the present invention is not limited to these embodiments, but may be modified by those skilled in the art without departing from the spirit and scope of the present invention, as defined in the appended claims.

What is claimed is:

1. A gas supply system, comprising:

a receiver assembly;

a gas storage vessel coupled to the receiver assembly;

a main poppet positioned at an end of the gas storage vessel and sealing the gas storage vessel when the main poppet is closed;

a pilot poppet positioned in the main poppet and sealing the gas storage vessel when the pilot poppet is closed; and a chamber positioned behind the main poppet, wherein a first end of the main poppet located at the chamber has a larger diameter than a second end of the main poppet located at the end of the gas storage vessel, wherein when the pilot poppet opens, gas from the gas storage vessel is released into the chamber to exert pressure on the main poppet to open the main poppet, wherein the main poppet moves into the gas storage vessel into a pressure stream of escaping gas from the gas storage vessel to open the main poppet, wherein a time for the main poppet to move into the gas storage vessel to reach a stop is less than or equal to about 20 ms.

2. The gas supply system as recited in claim 1, wherein the pilot poppet moves into a pressure stream of escaping gas from the gas storage vessel to open the pilot poppet.

3. The gas supply system as recited in claim 1, further comprising a receiver mounted plunger positioned behind the main and pilot poppets, wherein the plunger pushes the pilot poppet into a pressure stream of escaping gas from the gas storage vessel to open the pilot poppet.

4. The gas supply system as recited in claim 3, wherein, prior to actuation, the plunger is held in a retracted position by a receiver mounted trigger sear linkage.

5. The gas supply system as recited in claim 4, wherein the trigger sear linkage is actuated by a solenoid.

6. The gas supply system as recited in claim 1, wherein the escaping gas flows through a discharge port to a store ejection mechanism.

7. The gas supply system as recited in claim 1, wherein the gas storage vessel is coupled to the receiver assembly by screwing the gas storage vessel into the receiver assembly.

8. The gas supply system as recited in claim 1, wherein the gas storage vessel is pressurized and seals pressurized gas in the gas storage vessel prior to being coupled to the receiver assembly.

9. The gas supply system as recited in claim 1, wherein the main poppet includes a seal to plug an orifice in the gas storage vessel.

10. The gas supply system as recited in claim 1, wherein the pilot poppet includes a seal to plug an orifice in the main poppet.

11. The gas supply system as recited in claim 1, further comprising a receiver mounted sequencing valve, wherein the sequencing valve opens a vent to atmosphere for one side of the main poppet.

12. A method for supplying gas to a store ejection mechanism, comprising:

coupling a pressurized gas storage vessel to a receiver assembly;

positioning a main poppet at an end of the gas storage vessel to seal the gas storage vessel when the main poppet is closed, wherein a first end of the main poppet located at a chamber behind the main poppet has a larger diameter than a second end of the main poppet located at the end of the gas storage vessel, wherein the chamber is formed between and by attachment of the gas storage vessel to the receiver assembly;

positioning a pilot poppet in the main poppet to seal the gas storage vessel when the pilot poppet is closed;

pushing the pilot poppet toward the gas storage vessel into a stream of escaping gas from the gas storage vessel to open the pilot poppet and to fill a chamber positioned behind the main poppet with the escaping gas; and exerting pressure on the main poppet with the escaping gas to push the main poppet into the gas storage vessel to open the main poppet, wherein a time for the main poppet to move into the gas storage vessel to reach a stop is less than or equal to about 20 ms, wherein the chamber is not linked to a source of gas other than the escaping gas from the gas storage vessel.

13. The method as recited in claim 12, wherein the main poppet moves into the gas storage vessel against a pressure stream of escaping gas from the gas storage vessel.

14. The method as recited in claim 12, further comprising a receiver mounted plunger positioned behind the main and pilot poppets to push the pilot poppet toward the gas storage vessel.

15. The method as recited in claim 14, further comprising energizing a solenoid to actuate a trigger sear linkage to release the plunger from a retracted position.

16. The method as recited in claim 12, wherein the main poppet includes a seal to plug an orifice in the gas storage vessel.

17. The method as recited in claim 12, wherein the pilot poppet includes a seal to plug an orifice in the main poppet.

18. The method as recited in claim 12, further comprising opening a vent to atmosphere for one side of the main poppet.

19. A gas supply system for store ejection from a vehicle, comprising:

a receiver assembly; and a gas storage vessel removably coupled to the receiver assembly; and a main poppet positioned at an end of the gas storage vessel and sealing the gas storage vessel when the main poppet is closed, wherein a first end of the main poppet located at a chamber behind the main poppet has a larger diameter than a second end of the main poppet located at the end of the gas storage vessel, wherein:

the receiver assembly includes a charging port for connecting to a pressurized gas source on-board the vehicle, the port is connected to the gas storage volume in the gas storage vessel via a separate port and check valve, and the gas storage vessel is refilled with pressurized gas via the port wherein the pressurized gas from the gas storage vessel is released into and trapped in a chamber in the receiver assembly to exert pressure on the poppet and push the poppet into the gas storage vessel, wherein the main poppet moves into the gas storage vessel into a pressure stream of escaping gas from the gas storage vessel to open the main poppet, wherein a time for the main poppet to move into the gas storage vessel to reach a stop is less than or equal to about 20 ms, wherein the chamber is not linked to a source of gas other than the pressurized gas from the gas storage vessel.

20. The gas supply system of claim 19, wherein a seal is positioned between the gas storage vessel and the port, and the seal functions as a poppet seat.

21. The gas supply system of claim 19, wherein the pressurized gas source is a compressor.

22. The gas system as recited in claim 1, wherein the chamber traps the gas from the gas storage vessel against the main poppet.

23. The method as recited in claim 12, wherein the chamber traps the escaping gas against the main poppet.

* * * * *